US006612947B2

(12) United States Patent
Porter

(10) Patent No.: US 6,612,947 B2
(45) Date of Patent: Sep. 2, 2003

(54) RADIO TRANSMITTER ASSEMBLY FOR TRACKING AN ARROW

(75) Inventor: Sonny J. Porter, Carpenter, WY (US)

(73) Assignee: K-Tech LLC, Carpenter, WY (US)

( * ) Notice: Subject to any disclaimer, the term of this patent is extended or adjusted under 35 U.S.C. 154(b) by 0 days.

(21) Appl. No.: 10/032,839

(22) Filed: Oct. 19, 2001

(65) Prior Publication Data

US 2002/0091023 A1 Jul. 11, 2002

Related U.S. Application Data

(60) Provisional application No. 60/244,030, filed on Oct. 27, 2000.

(51) Int. Cl.[7] ..... F42B 6/04
(52) U.S. Cl. ..... 473/578
(58) Field of Search ..... 473/578

(56) References Cited

U.S. PATENT DOCUMENTS 3,790,948 A 2/1974 Ratkovich
4,675,683 A 6/1987 Robinson et al.
4,885,800 A * 12/1989 Ragle
4,943,067 A * 7/1990 Saunders
RE33,470 E 12/1990 Boy et al.
4,976,442 A 12/1990 Treadway
5,024,447 A * 6/1991 Jude
5,094,463 A * 3/1992 Dryden
5,450,614 A 9/1995 Rodriguez
5,516,117 A * 5/1996 Rangel

* cited by examiner

*Primary Examiner*—John A. Ricci
(74) *Attorney, Agent, or Firm*—Dorr, Carson, Sloan & Birney, P.C.

(57) ABSTRACT

A radio transmitter assembly for use in tracking an arrow employs an insert containing a radio transmitter that can inserted through the open end of an arrow and into the interior of the arrow shaft. After the insert has been secured within the arrow shaft, an arrow head can be secured to a connector on the insert.

14 Claims, 2 Drawing Sheets

Fig. 3
*(Amplitude Modulation)*
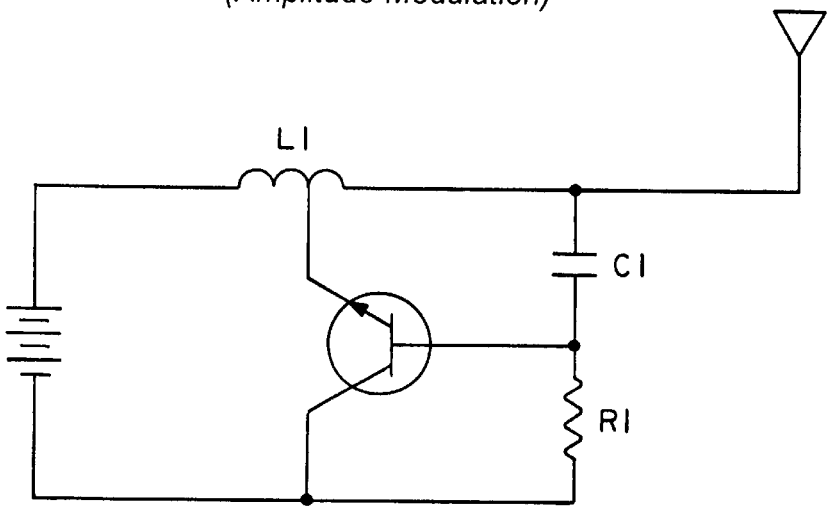
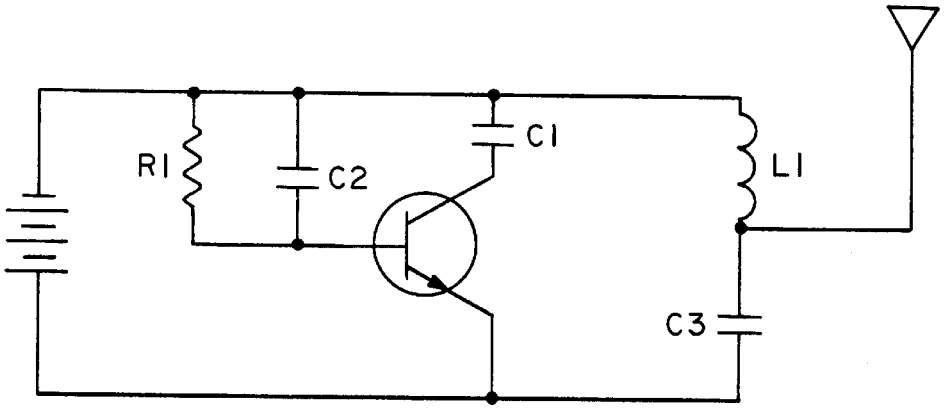
Fig. 4
*(Frequency Modulation)*

RADIO TRANSMITTER ASSEMBLY FOR TRACKING AN ARROW

RELATED APPLICATION

The present application is based on, and claims priority to the applicant's U.S. Provisional Patent Application No. 60/244,030, entitled "Radio Frequency Trackable Arrow With Receiver," filed on Oct. 27, 2000.

BACKGROUND OF THE INVENTION

1. Field of the Invention

The present invention relates generally to the field of remote tracking systems. More specifically, the present invention discloses a radio transmitter assembly for tracking an arrow.

2. Statement of the Problem

Modern hunting arrows can be relatively expensive. After being fired, arrows can become lost, broken, or become embedded in a wounded animal. Therefore, a need exists for a system to assist in tracking arrows.

The prior art in this field includes several examples of radio transmitters for tracking arrows, but these approaches have serious limitations or shortcomings. Placing a radio transmitter and its associated batteries in the head of an arrow results in an assembly that is too heavy and awkward for proper flight characteristics. Placing the radio transmitter within the shaft of the arrow creates a risk that the transmitter could be damaged if the shaft is broken, as is often the case when a wounded animal runs through heavy brush or woodlands. In that event, the hunter could lose his investment in both the arrow and the transmitter assembly.

Another difficulty associated with prior art approaches has been the limited life of the battery. Due to space and weight constraints, only a very small, light-weight battery can be used to power the radio transmitter. Therefore, a need also exists for a means to quickly and easily activate the transmitter before firing the arrow, so that battery life is maximized.

3. Prior Art

The following prior art patents disclose radio transmitters used to track the location of an arrow:

| Inventor | Patent No. | Issue Date |
|---|---|---|
| Ratkovich | 3,790,948 | Feb. 5, 1974 |
| Robinson et al. | 4,675,683 | Jun. 23, 1987 |
| Boy et al. | Re. 33,470 | Dec. 4, 1990 |
| Treadway | 4,976,442 | Dec. 11, 1990 |
| Rodriguez | 5,450,614 | Sep. 12, 1995 |

Ratkovich discloses a radio-transmitting hunting arrow in which the battery and transmitter are housed in the arrow head. The antenna extends from the arrow head along the hollow shaft of the arrow.

Robinson et al. disclose a radio transmitter for tracking spent hunting arrows in which the transmitter is placed in a cylindrical housing having the same cross-sectional diameter as the arrow shaft. The transmitter section is connected in series between the arrow head and the shaft of the arrow. However, this approach lengthens the arrow and changes its flight characteristics.

Boy et al. disclose a system for recovering a hunting arrow. A radio transmitter is housed within the arrow shaft. An inertial switch is employed to activate the transmitter.

Treadway discloses an arrow with a removable radio transmitter. The transmitter fits into a notch or slot in the arrow shaft. A curved hook attached to the transmitter projects through the notch or slot. If the arrow strike an animal, the hook engages the hide, bone, or tissue of the animal so that the transmitter will remain with the animal, regardless of the location of the arrow.

Rodriguez discloses an arrow tracking apparatus in which a radio transmitted is housed in a jacket that fits over the arrow shaft.

4. Solution to the Problem

None of the prior art references discussed above show a radio transmitter assembly for tracking the location of an arrow in which the transmitter is housed in an insert within the hollow arrow shaft. To minimize weight, most conventional hunting arrows have a hollow shaft. The arrow head is normally secured to the end of the shaft by means of threads that engage a threaded metal insert that has been permanently bonded into the end of the shaft. The present invention employs an insert that largely matches the weight and size of a conventional insert, but also houses a radio transmitter. This enables the present invention to be used in conjunction with conventional hunting arrows without significantly changing the length or weight of the arrow, or otherwise altering its flight characteristics.

In addition, the radio transmitter in the present invention is protected within the arrow shaft and insert. If the arrow strikes a hard object, the force of the impact is largely carried through the wall of the insert and the arrow shaft itself, rather than through the radio transmitter. If an animal is wounded by an arrow, the animal will often seek cover in heavy brush or woodlands, which can result in the arrow being snagged or broken. The insert used in the present invention minimizes the risk that the radio transmitter might be damaged or become detached from the animal if the arrow shaft is broken. In particular, the insert containing the radio transmitter is screwed securely onto the arrow head, which minimizes any risk that it will become detached from the animal. In addition, the insert is permanently bonded with adhesive into the end of the arrow shaft. This reinforces the end of the arrow shaft and makes its more likely that the shaft would break at a different point along its length. This configuration maximizes the probability that the arrow head and at least the adjacent portion of the arrow shaft containing the insert will remain with the animal.

SUMMARY OF THE INVENTION

This invention provides a radio transmitter assembly for use in tracking an arrow. An insert containing a radio transmitter is inserted through the open end of an arrow and into the interior of the arrow shaft. After the insert has been secured within the arrow shaft, an arrow head can be secured to the insert.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a schematic diagram of a radio transmitter circuit using amplitude modulation.

FIG. 4 is a schematic diagram of a radio transmitter circuit using frequency modulation.

DETAILED DESCRIPTION OF THE INVENTION

Figure 1:
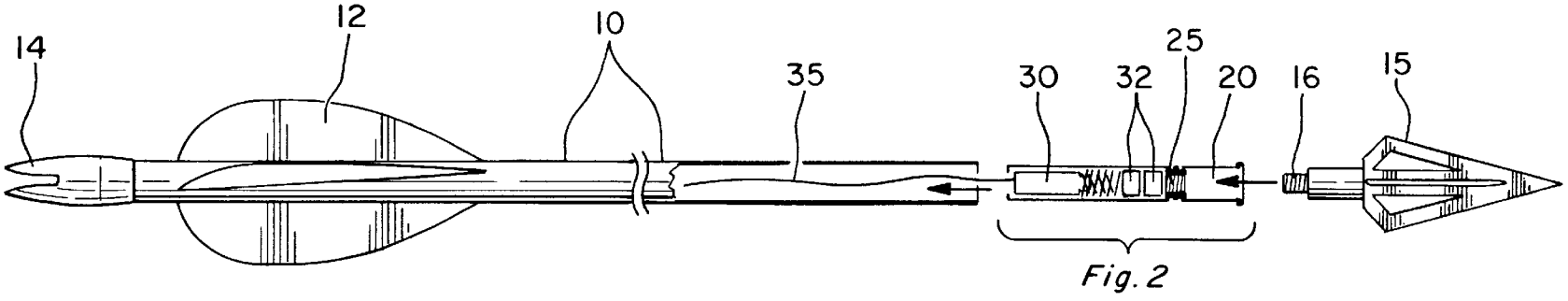
FIG. 1 is an exploded cross-sectional view of an arrow with the present radio transmitter assembly.

Turning to FIG. 1, an exploded cross-sectional view is provided of an arrow with the present radio transmitter assembly. The arrow itself can be conventional. For example, the arrow shown in FIG. 1 has a conventional shaft 10, fletching 12, nock 14, and head 15. The arrow shaft 10 is conventionally made of fiber glass or another suitable composite material. It typically has a hollow interior that is accessible through the open end of the arrow shaft 10. The arrow head 15 has a threaded base 16 that would allow it to be threaded into a conventional insert in the end of an arrow shaft 10.

Figure 2:
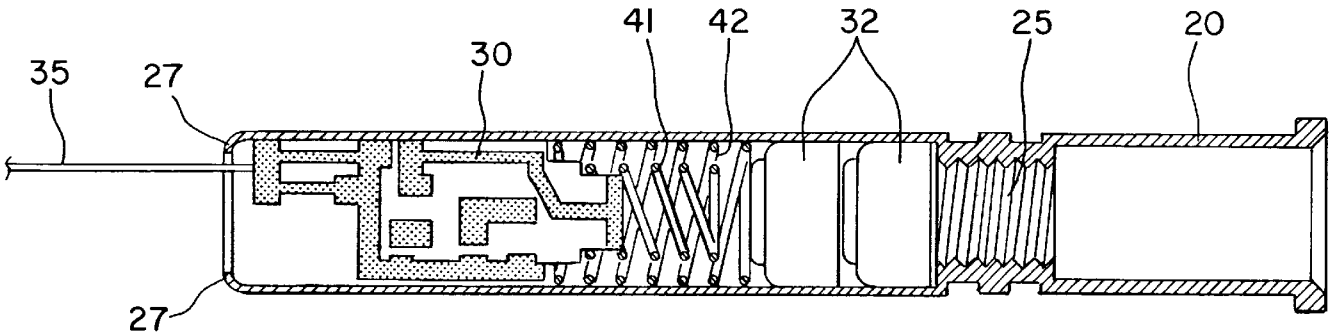
FIG. 2 is a detail cross-sectional view of the radio transmitter assembly.

In the present invention, the conventional insert is replaced with a radio transmitter assembly. FIG. 2 is a detail cross-sectional view of the radio transmitter assembly. The components of this assembly are housed in a generally cylindrical insert 20. This insert 20 has a socket 22 to receive the base of the arrow head 15 and threads 25 to engage the threads 16 on the arrow head 15. In the preferred embodiment of the present invention, an interior passageway extends along the longitudinal axis of the insert 20 from the socket 22 through the threads 25. The lower portion of the interior passageway contains a radio transmitter 30 and a number of batteries 32, as will be discussed below. The lower end 27 of the insert 20 can be constricted or crimped to hold the radio transmitter 30 and batteries 32 in place within the insert. Alternatively, these internal components could be potted or bonded with adhesive within the insert 20.

The insert 20 has exterior dimensions that allow it to be inserted through the open end of the arrow shaft 10 into the hollow interior of the arrow shaft 10. Insertion of the insert 20 continues until the upper end of the socket 22 is generally even with the open end of the arrow shaft 10. The insert 20 can be designed with substantially the same diameter as a conventional insert to result in a snug, friction-fit against the interior of the arrow shaft 10. This configuration allows the present invention to be directly substituted in place of a conventional insert without modifications to existing arrows. The insert 20 can be permanently bonded to the arrow shaft with adhesive or other equivalent means.

Either metallic or non-conductive materials can be used to fabricate the insert. If a conductive material is used, the body of the insert provides a degree of electromagnetic shielding for the radio transmitter 30 and can form part of the power circuit between the radio transmitter 30 and the batteries 32. However, a non-conductive insert simplifies assembly of the device and eliminates the risk that the insert might accidentally short the radio transmitter 30 or its antenna 35.

In the embodiment shown in FIGS. 1 and 2, the socket 22 and threads 25 serve as a connector to secure the arrow head 15 to the insert 20. This is largely a matter of convention to enable the present invention to be used in conjunction with existing arrow heads 15 having a threaded base 16. However, it should be understood that other types of connectors could be readily substituted to secure an arrow head 15 to the insert 20. For example, a bayonet-type connector could be used.

The output signal from the radio transmitter 30 is broadcast by an antenna 35 extending from the radio transmitter 30 through the insert 20 and along the interior of the shaft 10 of the arrow. For example, the antenna 35 can be a wire having a length of approximately one-quarter wavelength (e.g., approximately 6–15 inches).

The radio transmitter 30 is powered by a number of batteries 32 (e.g., two conventional 1.5 volt watch or calculator batteries providing a total of about 3.0 volts to the radio transmitter 30). In the preferred embodiment of the present invention, the batteries 32 are stacked in axial alignment with the radio transmitter 30 within the passageway of the insert 20. Two springs 41 and 42 form part of the circuit between the batteries 32 and the radio transmitter 30 in the embodiment depicted in FIG. 2.

If the arrow head 15 is not secured to the insert 20, the outer spring 42 pushes the batteries 32 upward and out of contact with the inner spring 41, as illustrated in FIG. 2. In this state, there is no electrical continuity between the batteries 32 and the radio transmitter 30. Thus, the radio transmitter 30 remains off while the arrow head is detached and battery power is conserved.

Screwing the arrow head 15 into the threads 25 of the insert 20 causes the base 16 of the arrow head 15 to come into contact with the upper battery 32. The arrow head 15 pushes both batteries 32 downward so that the lower battery will come into contact with the inner spring 41, which establishes electrical continuity between the batteries 32 and radio transmitter 30. In this state, radio transmitter 30 is turned on.

It should be expressly understood that other methods could be substituted to switch the radio transmitter on only when the arrow is about to be fired. For example, a simple set of electrical contacts could be closed in attachment of the arrow head 15 to the insert 20. A pressure-sensitive switch could be also be substituted.

The radio transmitter 30 can be designed to transmit any conventional radio signal that can be detected at a reasonable distance by a directional radio receiver (not shown). For example, FIG. 3 is a schematic diagram of a radio transmitter circuit using amplitude modulation. FIG. 4 is a schematic diagram of a radio transmitter circuit using frequency modulation. A frequency of approximately 100 to 300 MHz can be used for AM modulation, and a frequency of approximately 300 to 500 MHz can be used for FM modulation. The radio transmitter 30 can be fabricated in a very compact size using surface mount technology (SMT) with a phenolic printed circuit board. A transmitter output power of approximately 0.1 to 0.5 mW can be readily detected at a range of approximately 150 to 200 feet with a conventional radio receiver.

The above disclosure sets forth a number of embodiments of the present invention. Other arrangements or embodiments, not precisely set forth, could be practiced under the teachings of the present invention and as set forth in the following claims.

I claim:

1. A radio transmitter assembly for use in tracking an arrow having a head and a shaft with a hollow interior and an open end, said radio transmitter assembly comprising:

a non-conductive insert insertable through the open end of an arrow to engage the interior of the arrow shaft;

a radio transmitter housed within the insert; and a connector for securing an arrow head to the insert and thereby securing the arrow head to the arrow.

2. The radio transmitter assembly of claim 1 further comprising an antenna extending from the radio transmitter through the insert and along the interior of the shaft of the arrow.

3. The radio transmitter assembly of claim 1 wherein the head of an arrow is threaded into the connector.

4. The radio transmitter assembly of claim 1 wherein the insert is bonded into the interior of the shaft by means of adhesive.

5. The radio transmitter assembly of claim 1 further comprising at least one battery within the insert to power the radio transmitter, and wherein the radio transmitter is powered only while the arrow head is secured to the insert.

6. The radio transmitter assembly of claim 5 further comprising a spring compressed by insertion of the arrow head into the insert to establish electrical continuity between the battery and radio transmitter.

7. A radio transmitter assembly for use in tracking an arrow having a head and a shaft with a hollow interior and an open end, said radio transmitter assembly comprising:

a non-conductive insert insertable through the open end of an arrow to engage the interior of the arrow shaft;

a radio transmitter housed within the insert;

at least one battery housed within the insert to power the radio transmitter;

a connector for securing an arrow head to the insert; and a spring within the insert that is compressed when the arrow head is secured to the insert, said spring providing electrical continuity between the battery and the radio transmitter only while the arrow head is secured to the insert.

8. The radio transmitter assembly of claim 7 further comprising an antenna extending from the radio transmitter through the insert and along the interior of the shaft of the arrow.

9. The radio transmitter assembly of claim 7 wherein the head of an arrow is threaded into the connector.

10. The radio transmitter assembly of claim 7 wherein the insert is bonded into the interior of the shaft by means of adhesive.

11. The radio transmitter assembly of claim 7 further comprising a spring compressed by insertion of the arrow head into the connector or the insert to establish electrical continuity between the battery and radio transmitter.

12. A radio transmitter assembly for use in tracking an arrow having a head and a shaft with a hollow interior and an open end, said radio transmitter assembly comprising:

a non-conductive insert insertable through the open end of an arrow to engage the interior of the arrow shaft, said insert having an axially-extending interior passageway with threads to receive and engage an arrow head;

a radio transmitter within the insert;

at least one battery in axial alignment with the radio transmitter within the passageway of the insert; and an antenna extending from the radio transmitter along the interior of the shaft of the arrow;

whereby engaging the arrow head into the passageway of the insert establishes electrical continuity between the battery and radio transmitter.

13. The radio transmitter assembly of claim 12 wherein the insert is bonded into the interior of the shaft by means of adhesive.

14. The radio transmitter assembly of claim 12 further comprising a spring compressed by insertion of the arrow head into the passageway of the insert to establish electrical continuity between the battery and radio transmitter.

* * * * *